US009731502B2

(12) United States Patent
Hirobe

(10) Patent No.: US 9,731,502 B2
(45) Date of Patent: Aug. 15, 2017

(54) PRINTING APPARATUS AND DATA TRANSFER METHOD

(71) Applicant: CANON KABUSHIKI KAISHA, Tokyo (JP)

(72) Inventor: Kazuki Hirobe, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/150,849

(22) Filed: May 10, 2016

(65) Prior Publication Data

US 2016/0347056 A1 Dec. 1, 2016

(30) Foreign Application Priority Data

May 27, 2015 (JP) ..... 2015-107855

(51) Int. Cl.
*B41J 2/045* (2006.01)

(52) U.S. Cl.
CPC ..... *B41J 2/04573* (2013.01); *B41J 2/0458* (2013.01); *B41J 2/04528* (2013.01); *B41J 2/04543* (2013.01)

(58) Field of Classification Search
CPC B41J 2/04573; B41J 2/04528; B41J 2/04543; B41J 2/0458
See application file for complete search history.

(56) References Cited

FOREIGN PATENT DOCUMENTS

| | | | | |
|---|---|---|---|---|
| JP | 2010-131787 | | 6/2010 | |
| JP | 201310131787 | * | 6/2010 | ..... B41J 2/05 |
| JP | 2013-107341 | | 6/2013 | |
| JP | 2010131787 | * | 6/2013 | ..... B41J 2/045 |

* cited by examiner

*Primary Examiner* — Henok Legesse
(74) *Attorney, Agent, or Firm* — Fitzpatrick, Cella, Harper & Scinto

(57) ABSTRACT

According to an embodiment of this invention, the following data transfer between a printhead and a printing apparatus is performed. That is, a priority is set for each of a plurality of data to transfer the plurality of data. Print timings of the printhead are generated in accordance with a relative moving speed between the printhead and a print medium, and the print resolution of the printhead. Data to be transferred to the printhead in an interval between the generated print timing and the next print timing following the print timing are selected from the plurality of data based on the interval, the data length of each of the plurality of data, and the set priorities. The selected data are transferred to the printhead.

20 Claims, 9 Drawing Sheets

PRINTING APPARATUS AND DATA TRANSFER METHOD

BACKGROUND OF THE INVENTION

Field of the Invention

The present invention relates to a printing apparatus and a data transfer method, and particularly to, for example, a printing apparatus which prints on a print medium by using an inkjet printhead and a data transfer method between the printhead and the printing apparatus.

Description of the Related Art

A conventional inkjet printhead (to be referred to as a printhead hereinafter) includes a plurality of orifices which discharge ink, heaters corresponding to the orifices, a sub-heater which warms up the overall printhead, and a plurality of diode sensors which measure the temperature of the printhead.

The following data are required for printing control of a printing apparatus which performs printing by using a printhead mounted on a carriage which reciprocally moves. That is, the required data include print data for selecting orifices, of the plurality of orifices provided in the printhead, from which ink should be discharged, and heat pulse data for driving the heaters at the selected orifices. In addition, the required data include sub-heater control data for driving/controlling the sub-heater and diode sensor selection data for selecting a desired sensor from a plurality of diode sensors.

Of the above data, the print data and the heat pulse data are data which need to be transferred from the main body unit of the printing apparatus to the printhead for each discharging operation in accordance with the discharge timing of the printhead. In contrast to this, the sub-heater control data and the diode sensor selection data are data which need not be transferred for each discharge timing of the printhead and are allowed to be transferred at given predetermined intervals longer than the period of the discharge timing. For example, Japanese Patent Laid-Open No. 2010-131787 discloses an arrangement for performing sub-heater control independently of ink discharge control.

In order to control the printhead, a plurality of signal lines are provided between the printhead and the controller of the main body unit. Reducing the number of such signal lines will lead to the downsizing of an FFC (Flexible Flat Cable) which connects them, and hence is an effective means for achieving a reduction in the cost of the printing apparatus. As a means for reducing the number of signal lines, for example, data conventionally controlled by two signal lines may be integrated into data to be controlled by one signal line. In this case, however, the amount of data to be transferred through one signal line increases. Japanese Patent Laid-Open No. 2013-107341 has proposed a technique employing the LVDS scheme as a high-speed data transfer means for discharging ink at a timing similar to that in the related art without increasing the number of signal lines in a case where the amount of data transferred to the printhead has increased.

For example, it is possible to further reduce the number of signal lines by transferring sub-heater control data and print data through the same signal line.

According to the related art described above, however, an increase in the amount of data transferred through the same signal line makes it impossible to accommodate all transfer data within a time interval during which data should be transferred to the printhead. In a case where a carriage speed is increased to implement high-resolution, high-speed printing, in particular, a time interval assigned to data transfer to the printhead is shortened. In this case, obviously, the above problem occurs.

SUMMARY OF THE INVENTION

Accordingly, the present invention is conceived as a response to the above-described disadvantages of the conventional art.

For example, a printing apparatus and a data transfer method according to this invention are capable of performing proper data transfer even if the number of signal lines connected to a printhead is small.

According to one aspect of the present invention, there is provided a printing apparatus which causes a printhead to print on a print medium by transferring a plurality of data to the printhead and driving the printhead while moving the printhead and the print medium relatively to each other, the apparatus comprising: a setting unit configured to set a priority for each of the plurality of data to transfer the plurality of data; a generation unit configured to generate print timings of the printhead in accordance with (1) a moving speed of the printhead or the print medium and (2) a print resolution of the printhead; a selection unit configured to select, from the plurality of data, data to be transferred to the printhead in an interval between a print timing generated by the generation unit and a next print timing following the print timing, based on the interval, a data length of each of the plurality of data, and priorities set by the setting unit; and a transfer unit configured to transfer data selected by the selection unit to the printhead.

According to another aspect of the present invention, there is provided a data transfer method for a printing apparatus which causes a printhead to print on a print medium by transferring a plurality of data to the printhead and driving the printhead while moving the printhead and the print medium relatively to each other, the method comprising: setting a priority for each of the plurality of data to transfer the plurality of data; generating print timings of the printhead in accordance with (1) a moving speed of the printhead or the print medium and (2) a print resolution of the printhead; selecting, from the plurality of data, data to be transferred to the printhead in an interval between a generated print timing and a next print timing following the print timing, based on the interval, a data length of each of the plurality of data, and the set priorities; and transferring the selected data to the printhead.

The invention is particularly advantageous since it is possible to select transfer data for the printhead based on a print timing interval, the priority of each data, and the data length of each data even if the amount of data required to be transferred to the printhead on the same signal line increases with a reduction in the number of signal lines or the like.

Further features of the present invention will become apparent from the following description of exemplary embodiments (with reference to the attached drawings).

DESCRIPTION OF THE EMBODIMENTS

Figure 1:
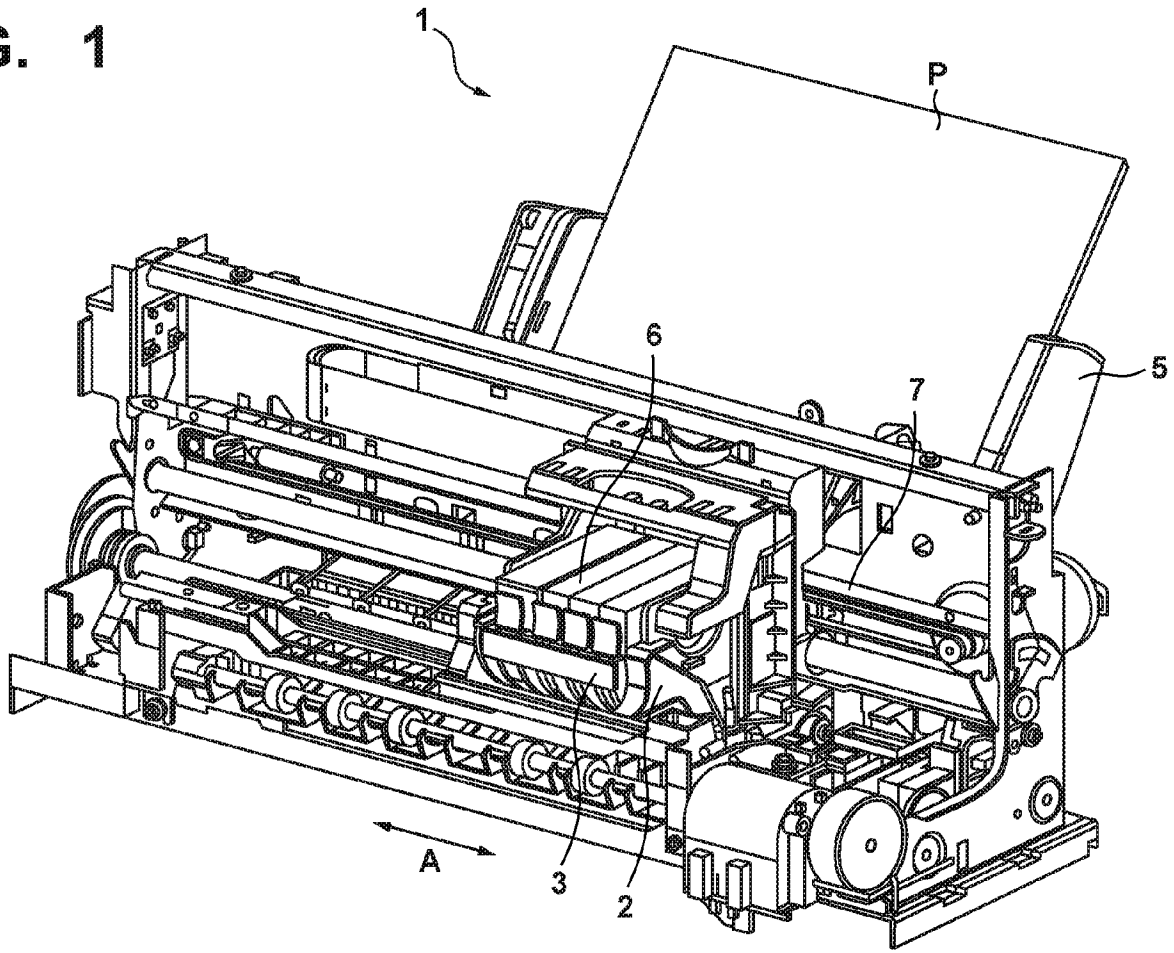
FIG. 1 is an outer perspective view showing the schematic arrangement of an inkjet printing apparatus according to an exemplary embodiment of the present invention.

Exemplary embodiments of the present invention will now be described in detail in accordance with the accompanying drawings. Note that the same reference numerals denote the same parts as those already described, and a repetitive description will be omitted.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Further, a "print element" (to be also referred to as "nozzle") generically means an ink orifice or a liquid channel communicating with it, and an element for generating energy used to discharge ink, unless otherwise specified.

<Overview of Printing Apparatus (FIGS. 1 and 2)>

FIG. 1 is a perspective view showing the schematic outer appearance of a printing apparatus that performs printing by using an inkjet printhead (to be referred to as a "printhead" hereinafter) according to an exemplary embodiment of the present invention.

As shown in FIG. 1, an inkjet printing apparatus (to be referred to as a printing apparatus) 1 has an inkjet printhead (to be referred to as a printhead hereafter) 3 which prints by discharging ink in accordance with an inkjet method and is mounted on a carriage 2. The printing apparatus 1 prints by reciprocally moving the carriage 2 in the direction indicated by an arrow A. This apparatus prints by feeding a print medium P such as a print sheet via a paper feed mechanism 5, conveying the print medium P to a printing position, and discharging ink from the printhead 3 to the print medium P at the printing position.

In addition to the printhead 3, ink tanks 6 which store inks to be supplied to the printhead 3 are mounted on the carriage 2 of the printing apparatus 1. The ink tanks 6 are detachably mounted on the carriage 2.

The printing apparatus 1 shown in FIG. 1 can perform color printing, and hence four ink cartridges respectively containing inks of magenta (M), cyan (C), yellow (Y), and black (K) are mounted on the carriage 2. These four ink cartridges can be independently attached/detached.

The printhead 3 according to this embodiment adopts an inkjet method of discharging ink by using thermal energy. For this reason, the printhead 3 includes electrothermal transducers. The electrothermal transducers are provided in correspondence with the respective orifices. In accordance with a print signal, pulse voltages are applied to corresponding electrothermal transducers to discharge ink from corresponding orifices.

A scale 7 is provided along the moving direction of the carriage 2. The scale 7 is provided with slits at predetermined intervals. An encoder (not shown) mounted on the carriage 2 generates an encoder signal by reading the slits as the carriage 2 moves. This encoder signal is a signal representing the carriage position (that is, the printhead position) in the moving direction of the carriage 2. The moving speed of the carriage is calculated based on the period of this encoder signal (encoder signal interval). The encoder signal is also used as a signal for timing control for the discharge of ink.

Figure 2:
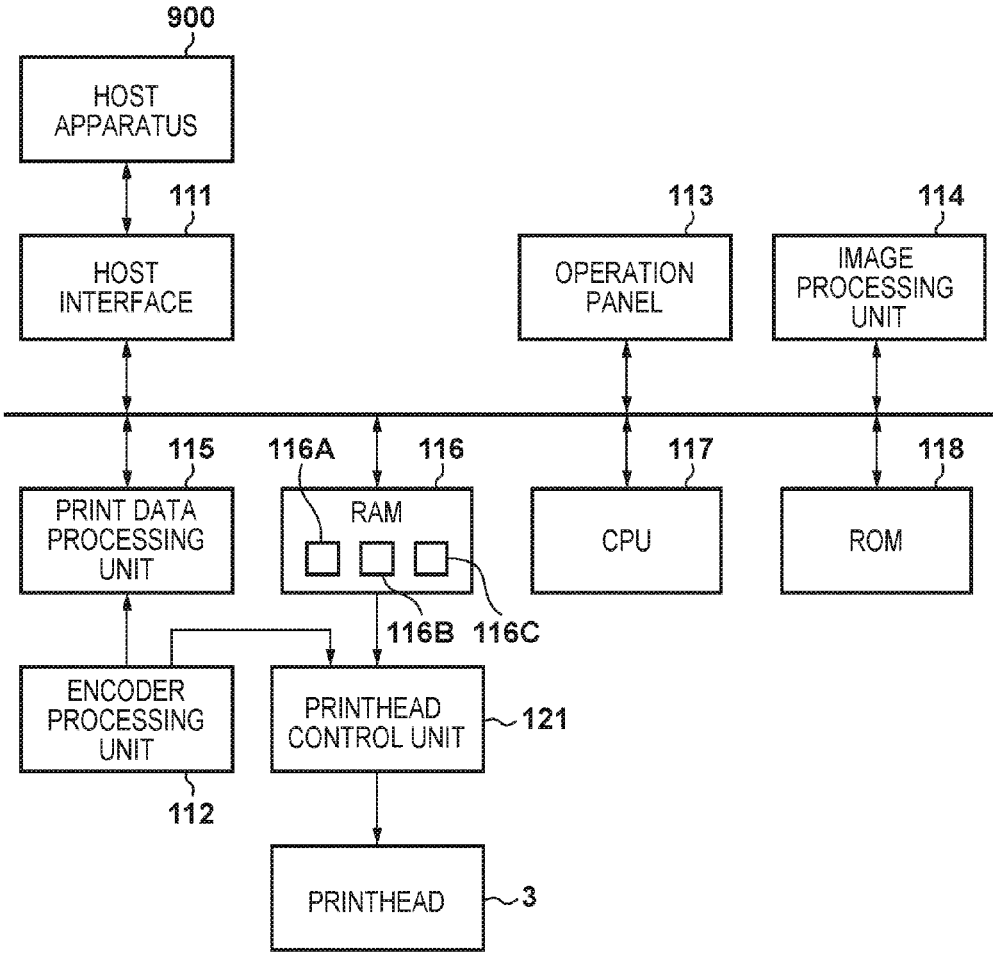
FIG. 2 is a block diagram showing the control arrangement of the inkjet printing apparatus shown in FIG. 1.

FIG. 2 is a block diagram showing the control arrangement of the printing apparatus shown in FIG. 1.

As shown in FIG. 2, a CPU 117 executes driving control of the print elements of the printhead, relative conveyance control of the print elements and a print medium (for example, a print sheet), and the like by executing control programs stored in a ROM 118.

A host interface 111 receives image data from a host apparatus 900 to which the host interface is connected. The image data is stored in a reception buffer 116A provided in a RAM 116. An image processing unit 114 converts the image data into multivalued data of C, M, Y, and K color components, and stores the data in a multivalued data buffer 116B provided in the RAM 116. A print data processing unit 115 converts the multivalued data of the respective color components into dot data (binary data), and stores the data in a dot data buffer 116C.

A printhead control unit 121 transfers the binary data stored in the dot data buffer 116C to the printhead 3. The printhead control unit 121 also has a function of thinning binary data in addition to the function of performing data transfer. The print data processing unit 115 converts the multivalued data of the respective color components into dot data (binary data) in synchronism with a heat trigger signal TRG output based on an encoder signal from an encoder processing unit 112. In addition, the printhead control unit 121 can execute processing in accordance with the conveyance timing of a print medium in synchronism with a block trigger BTRG (print timing) output from the encoder processing unit 112.

Note that the user issues various types of instructions to the printing apparatus by using an operation panel 113, and the printing apparatus 1 displays messages on the display unit of the operation panel 113. This makes it possible to notify the user of various types of information.

<Description of Nozzle Arrangement of Printhead (FIGS. 3A to 3C)>

Figure 3A:
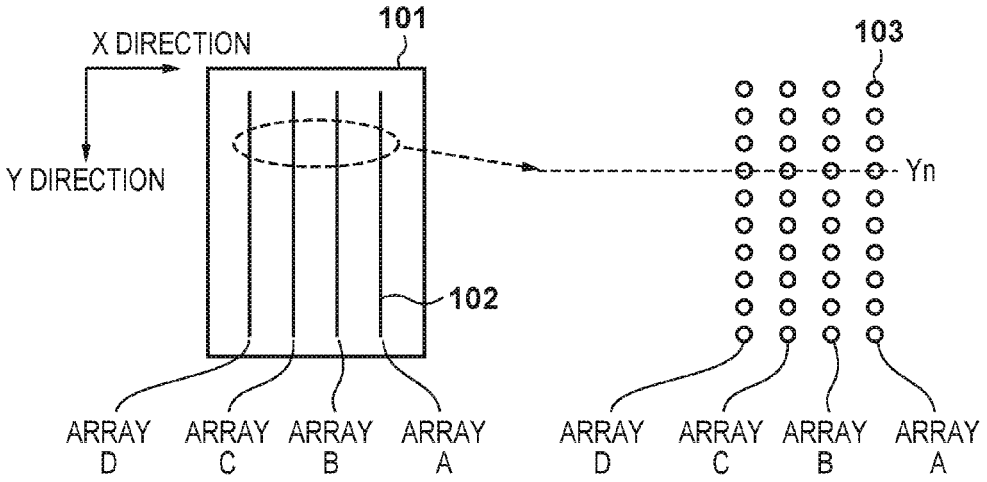
FIGS. 3A, 3B, and 3C are block diagrams each showing the nozzle arrangement of a printhead mounted on a carriage.
Figure 3B:
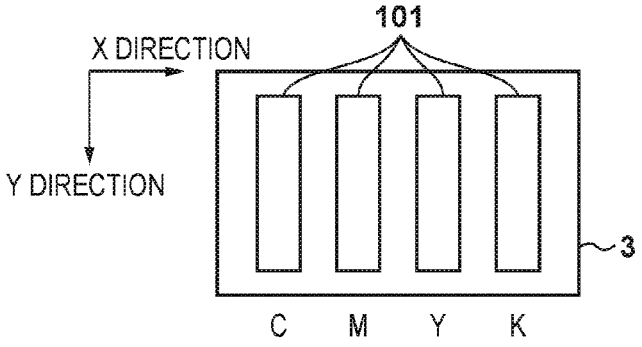
Figure 3C:
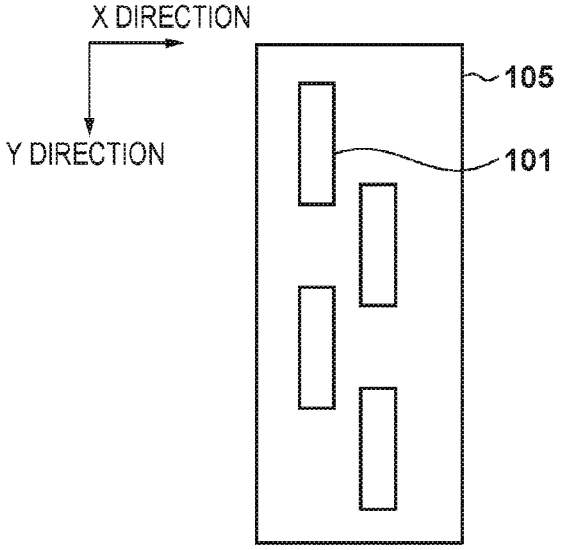

FIGS. 3A to 3C are block diagrams each showing the nozzle arrangement of the printhead 3 mounted on the carriage 2.

FIG. 3A shows the nozzle arrangement of a head unit 101 including four print element arrays 102 (arrays A, B, C, and D) having a plurality of print elements (electrothermal transducers (heaters) and corresponding nozzles which discharge ink) 103.

As shown in FIG. 3A, the plurality of print elements 103 are arrayed along the Y direction. Referring to the portion surrounded by the broken line, the respective print elements 103 of arrays A to D are arranged at the same positions in the Y direction. For example, dots formed on a print medium by ink discharged from the four print elements at the position of a broken line Yn are formed at the same positions in the Y direction. In addition, the print element arrays 102 are arranged in the X direction (the carriage moving direction (main scanning direction) corresponding to the direction indicated by the arrow A in FIG. 1). The four print element arrays of the head unit 101 described above complete image printing using one color component of Y, M, C, and K color components.

In order to form a color image by using color image data constituted by four Y, M, C, and K components, the printhead 3 constituted by the four head units 101 is formed in correspondence with inks of four colors (cyan, magenta, yellow, and black), as shown in FIG. 3B.

Note that in order to form a head unit 105 having a long print width, the plurality of head units 101 may be arranged in a zigzag pattern, as shown FIG. 3C.

In addition, a printhead with a long print width can be formed into a full-line printhead whose print width corresponds to an overall print medium in the widthwise direction. In this case, the conveying direction of a print medium relative to the arraying direction (Y direction) of the print elements is the X direction, and the print elements discharge ink to perform printing in accordance with the conveyance timing of the print medium during conveyance in the X direction.

<Data Transfer Timing Generation (FIG. 4)>

Data transfer timing generation generally used in the printing apparatus will be described next.

Figure 4:
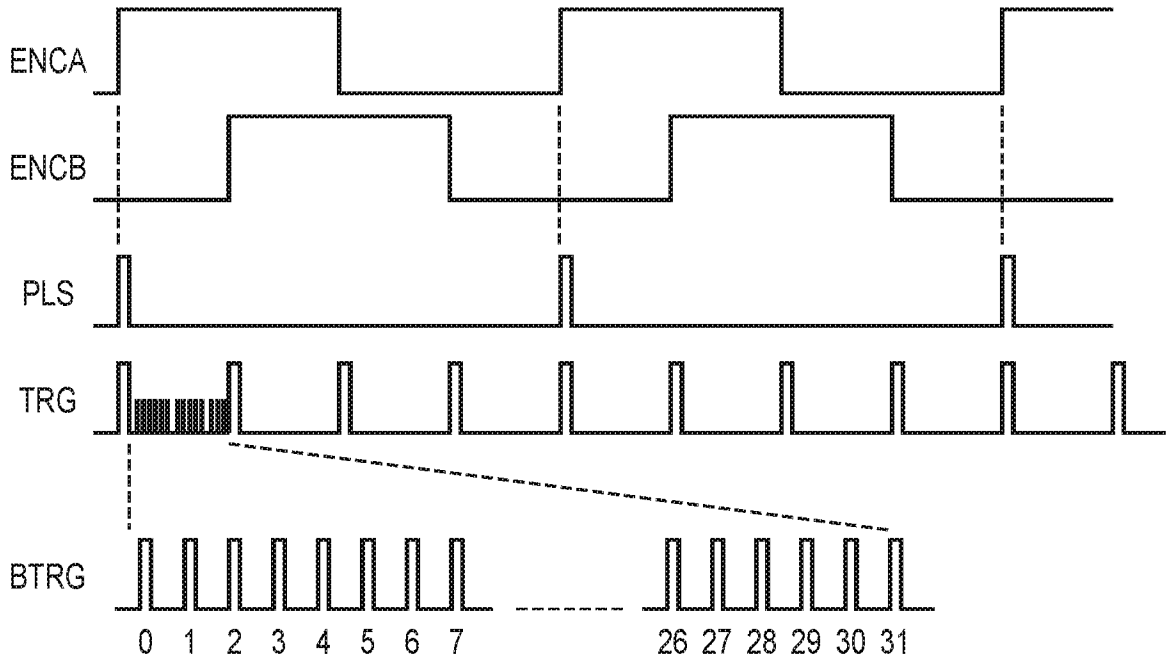
FIG. 4 is a timing chart of each signal used for time division driving performed by dividing one-column print data into data corresponding to 32 timings.

FIG. 4 is a timing chart of each signal used to perform time division driving by dividing one-column print data into data corresponding to 32 timings. Performing time division driving in this manner can reduce the influence of a voltage drop in drive voltage applied to each print element.

The encoder processing unit 112 receives an A-phase encoder signal ENCA and a B-phase encoder signal ENCB shifted in phase by ¼ period from the A-phase encoder signal ENCA shown in FIG. 4 from the encoder. As shown in FIG. 4, the encoder processing unit 112 generates a reference pulse PLS at a leading edge of the A-phase encoder signal ENCA, and generates a heat trigger signal TRG, which is output at intervals corresponding to the print resolution, by multiplying a frequency of the reference pulse PLS.

In addition, a block trigger signal BTRG (latch signal) is generated by dividing the period of the heat trigger signal TRG by 32. Data are input to the printhead 3 at the timing of the block trigger signal BTRG. It is possible to print at a desired position by performing data transfer within the period of the block trigger signal BTRG generated based on an encoder signal as position information concerning the carriage 2 in this manner.

<Detailed Description of Arrangement of Printhead Control Unit (FIG. 5)>

Figure 5:
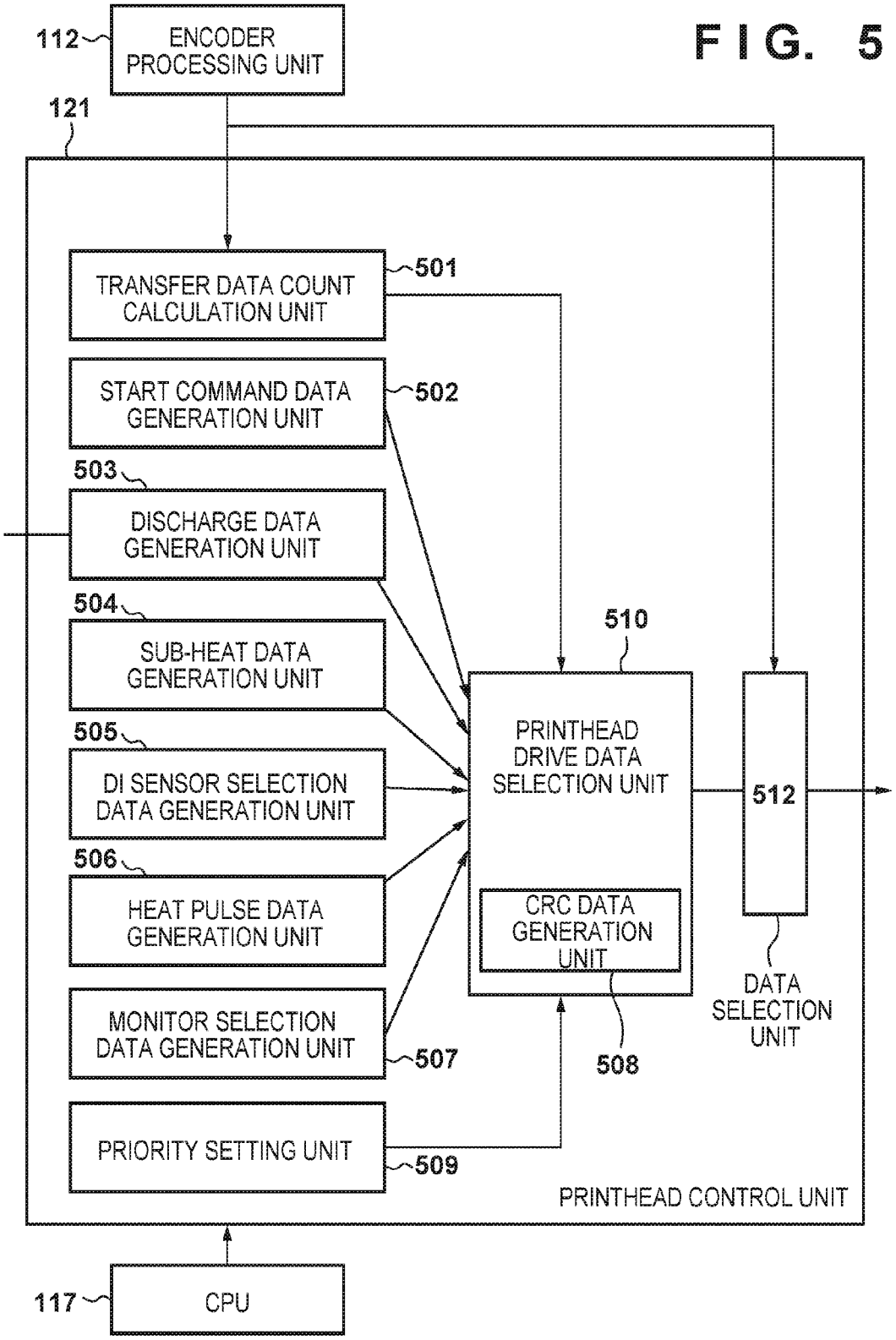
FIG. 5 is a block diagram showing the detailed arrangement of a printhead control unit.

FIG. 5 is a block diagram showing the detailed arrangement of the printhead control unit 121.

As shown in FIG. 5, the printhead control unit 121 is constituted by 10 components. A transfer data count calculation unit 501 receives the minimum block trigger interval set in the encoder processing unit 112 or a block trigger interval generated by the encoder processing unit 112 and calculates the number of data bytes which are transferrable in the interval of the block trigger signal BTRG.

A start command data generation unit 502 generates start command data for controlling the printhead 3. A discharge data generation unit 503 receives dot data from the dot data buffer 116C and generates print data DATA for controlling the printhead 3. A sub-heat data generation unit 504 generates sub-heater On/Off data for controlling the temperature of the printhead 3.

A Di sensor selection data generation unit 505 generates Di sensor selection data for selecting one of a plurality of diode sensors provided for the printhead 3. A heat pulse data generation unit 506 generates heat pulse data to be applied to the heaters to discharge ink from the printhead 3. A monitor selection data generation unit 507 generates monitor selection data for selecting one of a plurality of monitor signals output from the printhead 3. This is data for selecting a detection target for detecting the state of a Di sensor or heat pulse in the printhead 3. A CRC data generation unit 508 generates CRC data used for error detection of data transferred to the printhead 3. A priority setting unit 509 is a register of the printhead control unit 121, and can set a priority corresponding to each of the above data. This priority setting will be described later. The respective data generation units 502 to 508 each assert a data transfer request by transmitting a request signal for transferring each of the generated data to a printhead drive data selection unit 510.

When each request for each of the above data is asserted in accordance with a block trigger reference, the printhead drive data selection unit 510 selects data to be transferred to the printhead 3 based on a set value in the priority setting unit 509 and a result obtained by the transfer data count calculation unit 501. The selected data is transferred from a data selection unit 512 to the printhead 3.

The priority of printhead control data which is set in the priority setting unit 509 will be described next. Assume that in the following description, the following seven types of data are required as printhead control data for controlling the printhead 3: start command data (1 byte), print data (8 bytes), heat pulse data (2 bytes), sub-heater On/Off data (2 bytes), Di sensor selection data (2 bytes), monitor selection data (2 bytes), and CRC data (2 bytes). In this case, the values in the parentheses represent the data lengths of the respective data in bytes.

In this embodiment, it is possible to set a priority corresponding to each of the above printhead control data in the priority setting unit 509. Alternatively, priorities can be set in a plurality of patterns. For example, it is possible to use priority settings in different patterns depending on whether data is located inside or outside a printing region.

For the sake of descriptive simplicity, assume that there is one priority pattern. The following will exemplify a case in which a priority is set for each of the above printhead control data in the following manner:

printhead control data a . . . (start command data): set value 1 printhead control data b . . . (print data): set value 1 printhead control data c . . . (heat pulse data): set value 1 printhead control data d . . . (Di sensor selection data): set value 2 printhead control data e . . . (sub-heater data): set value 2 printhead control data f . . . (monitor selection data): set value 3 printhead control data g . . . (CRC data): set value 1

It is desirable to set the priority set value of each printhead control data to a value closer to "1" as higher real-time performance is required. In the above case, printhead control data d, e, and f are generated on the premise that real-time performance required for control of them is lower than that required for control of printhead control data a, b, and g. In addition, each printhead control data whose set value is set to "2" or more is based on the premise that a request signal REQ is asserted with a low frequency. In the above case, with respect to each of printhead control data d, e, and f, the request signal REQ is asserted in at least an interval equal to or more than three block trigger signals BTRG.

The real-time performance described above corresponds to the time from the instant the request signal REQ is issued to the instant data transfer processing should be actually performed and completed, that is, the necessity of instantaneous execution from the issuance of a request. In the above case, the time required to complete processing from the issuance of the request signal REQ for each of printhead control data d, e, and f is longer than that for each of printhead control data a, b, and g. This is because print data b needs to be transmitted with a high frequency to sequentially perform printing along with the movement of the carriage, whereas sub-heater data e is allowed to be transmitted with a comparatively lower frequency since temperature control processing need not be performed very often. That is, the priorities of the above printhead control data comply with the frequencies of driving of devices using the respective printhead control data within a unit time.

An embodiment of the transfer processing of transferring the above printhead control data to the printhead in the printing apparatus having the above arrangement will be described next.

First Embodiment

Assume that in this embodiment, a transfer data count calculation unit 501 receives the minimum block trigger interval set in an encoder processing unit 112, and the minimum block trigger interval is a value that allows the transfer of printhead control data of 15 bytes. The value indicated by the above priority set value represents the number of block triggers corresponding to an interval within which transfer must be completed since the assertion of a transfer request for each printhead control data. For example, transfer requests for all printhead control data are concurrently asserted, the data are transferred in the manner described below.

<Processing Executed by Printhead Control Unit (FIGS. 6 and 7)>

Processing executed by a printhead control unit 121 will be described below with reference to FIGS. 6 and 7.

Figure 6:
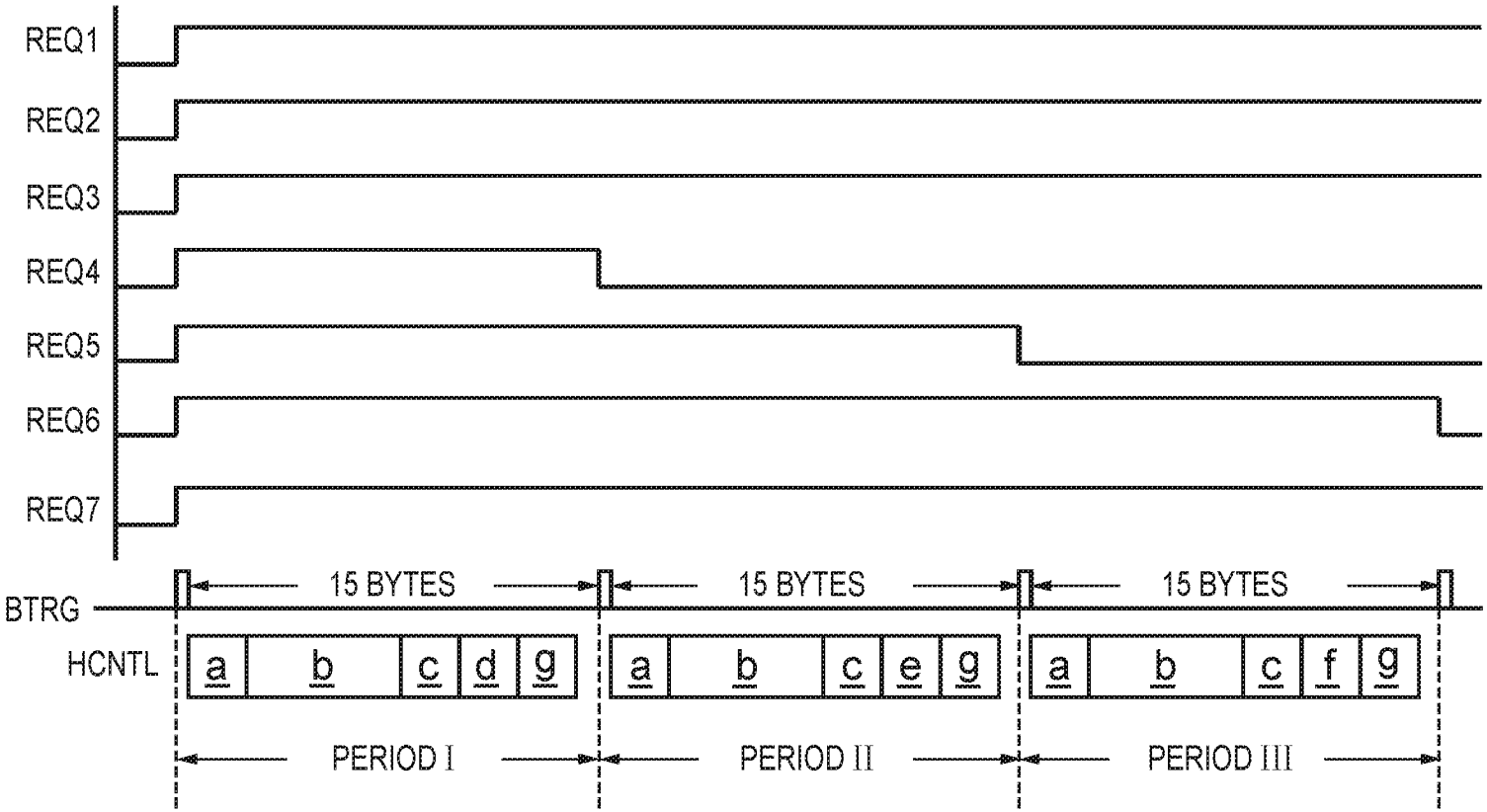
FIG. 6 is a timing chart of the transfer of each data upon transferring seven types of printhead control data to a printhead by dividing the data into data corresponding to three periods.

FIG. 6 is a timing chart of the transfer of seven types of printhead control data described above when the data are transferred to the printhead upon being divided into data corresponding to three periods. FIG. 7 is a flowchart showing transfer processing executed by the printhead control unit 121.

As shown in FIG. 6, printhead control data HCNTL is transferred upon being temporarily divided into data corresponding to three periods (periods I, II, and III). Referring to FIG. 6, a to g shown in the printhead control data HCNTL respectively correspond to the seven types of printhead control data a to g described above. As transfer processing for the printhead control data in each period, the processing shown in FIG. 7 is executed.

(1) Transfer Processing in Period I

When the input of a block trigger signal BTRG from the encoder processing unit 112 is detected in step S601, transfer selection data processing of printhead control data is executed in step S602. Referring to FIG. 7, steps S604 to S614 are the detailed contents of the processing in step S602. In this processing, transfer data selection processing is executed for all the printhead control data. In this case, a printhead control data count ND is 7 (ND=7) corresponding to printhead control data a to g.

In step S604, "1" is set as an initial value in a printhead control data count counter NDC. In step S605, "0" is set as an initial value in a transfer data byte count counter TDC. In step S606, the process waits for the count of the transfer data byte count counter TDC.

When TDC=1 upon execution of a counting operation, the process advances to step S607 to check whether the assertion of a request signal REQ1 for printhead control data a is detected. The printhead control data HCNTL processed in accordance with the value of the printhead control data count counter NDC is sequentially processed in the order in which priority set values PRI are closer to "1". Based on the above set values, therefore, printhead control data a is processed first when TDC=1, and printhead control data b is processed when TDC=2. Subsequently, printhead control data c, g, d, e, and f are processed in the order named.

In step S607, when the assertion of the request signal REQ1 for printhead control data a is detected, the process advances to step S608 to determine the priority set value PRI of printhead control data a. More specifically, it is checked whether the priority set value PRI is "1". If PRI=1, the process advances to step S610 to select printhead control data a as transfer data. In addition, in step S612, a byte count BYTE (1 byte in this case) of printhead control data a is added to the transfer data byte count counter TDC.

The process then advances to step S613 to increment the value of the printhead control data count counter NDC by 1. In addition, in step S614, the printhead control data count counter NDC is compared with the printhead control data count ND. If NDC 7, the processing is terminated. If NDC<ND (=7), the process returns to step S606.

Next, with regard to NDC=2, that is, printhead control data b, if the assertion of a request signal REQ2 for printhead control data b is detected, the same processing as that executed when NDC=1, that is, the processing for printhead control data a, is executed. Likewise, with regard to NDC=3, that is, printhead control data c, and NDC=4, that is, printhead control data g, if the assertion of corresponding request signals REQ3 and REQ7 is detected, the same processing as that executed for printhead control data a is executed.

When NDC=5, printhead control data d is processed.

In this case, as indicated by FIG. 6, it is determined in step S607 that the assertion of a request signal REQ4 for printhead control data d is detected. The process then advances to step S608. However, since the priority set value PRI of printhead control data d is "2", the process advances to step S609 based on the determination made in step S608. The execution of processing corresponding to NDC=1 to 4 has advanced the transfer data byte count counter to TDC=13. In step S609, it is checked whether the sum of TDC obtained by the previous processing and the byte count BYTE of the printhead control data HCNTL as a current processing target is equal to or less than a data amount THB that is transferrable in the minimum block trigger interval.

In this case, since the byte count of printhead control data d is 2 and the transferrable data amount falling within a block trigger interval is 15 bytes, it is determined in step S609 that TDC+BYTE≤THB. The process then advances to step S610. The subsequent processing is the same as that described above.

If, however, NDC=6 and the assertion of a request signal REQ5 is detected to execute processing for printhead control data e, it is determined in step S609 that TDC=15, BYTE=2, and THB=15. As a consequence, it is determined that TDC+BYTE>THB. The process then advances to step S611, and printhead control data e is not selected as transfer data.

Likewise, if NDC=7 and the assertion of a request signal REQ6 is detected to execute processing for printhead control data f, it is also determined in step S609 that TDC+BYTE>THB. The process then advances to step S611. Therefore, printhead control data f is not selected as transfer data.

With the above processing, processing for all the seven types of printhead control data is completed. As a result, in period I, as shown in FIG. 6, printhead control data a, b, c, d, and g are selected. Thereafter, in step S603, the selected printhead control data are transferred to the printhead 3.

(2) Transfer Processing in Period II

Figure 7:
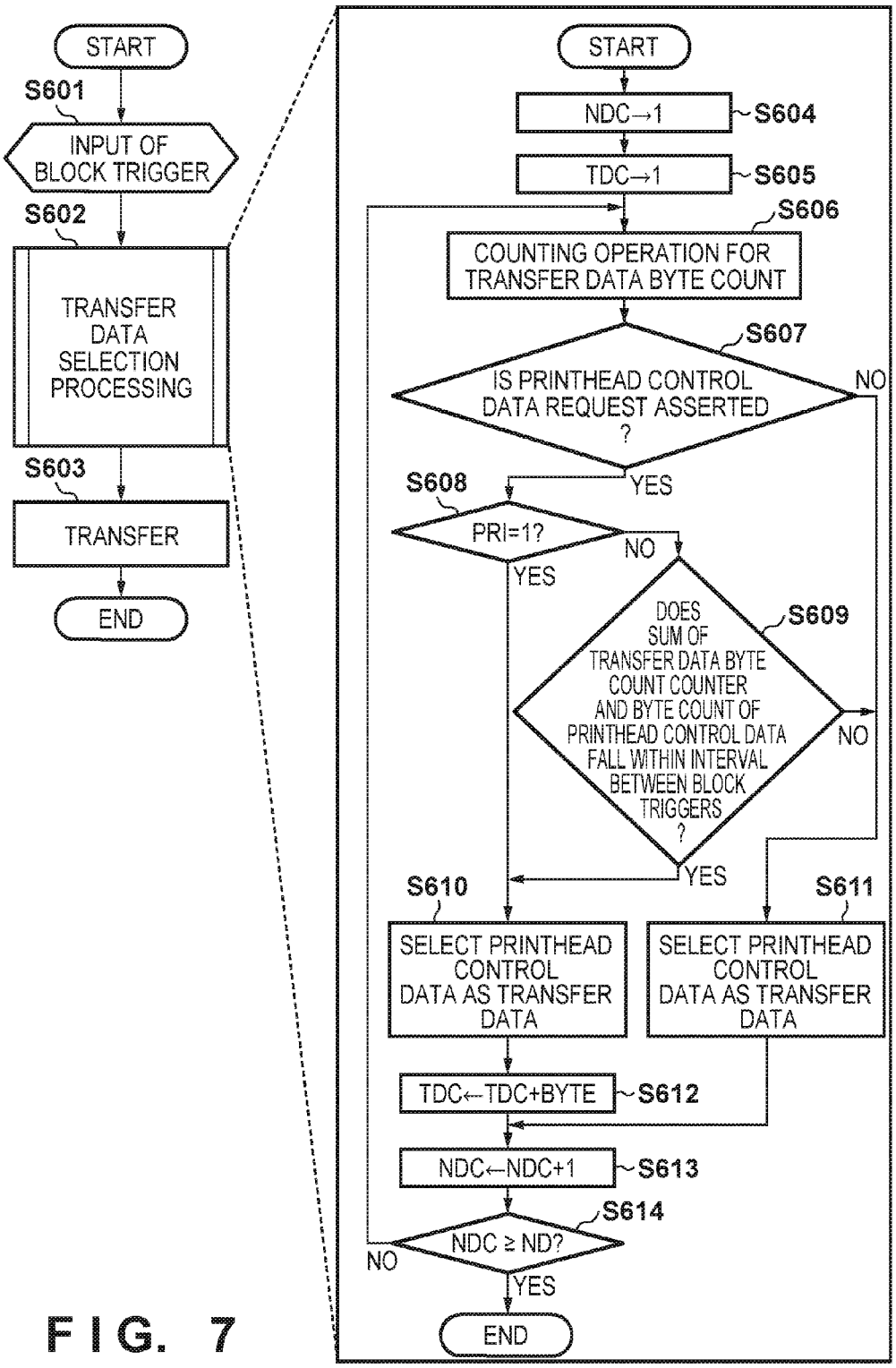
FIG. 7 is a flowchart showing transfer processing executed by the printhead control unit.

Basically, the same processing as that in period I is executed in accordance with the flowchart shown in FIG. 7. In this case, however, the request signal REQ4 is negated, and hence printhead control data d is not selected as transfer data. In contrast to this, the assertion of the request signal REQ5 is detected. At this point of time, that is, with processing up to NDC=5, TDC=13. Consequently, printhead control data e is selected as transfer data.

In addition, the assertion of the request signal REQ6 is detected. However, at this point of time, that is, with processing up to NDC=6, TDC=15. Consequently, printhead control data f is not selected as transfer data.

With the above processing, printhead control data a, b, c, e, and g are selected in period II. In step S603, the selected printhead control data HCNTL is transferred to the printhead 3.

(3) Transfer Processing in Period III

Basically the same processing as that in period I is executed in accordance with the flowchart shown in FIG. 7. In this case, however, the request signals REQ4 and REQ5 are negated, and hence printhead control data d and e are not selected as transfer data. In contrast to this, the assertion of the request signal REQ6 is detected. However, at this point of time, that is, with processing up to NDC=6, TDC=13. Consequently, printhead control data f is selected as transfer data.

With the above processing, printhead control data a, b, c, f, and g are selected in period III. In step S603, the selected printhead control data HCNTL is transferred to the printhead 3.

In the above manner, the printhead control data HCNTL is selected as transfer data and transferred to the printhead 3, as shown in FIG. 6.

According to the above embodiment, therefore, even if there are many types of printhead control data, priorities are set for the respective transfers and printhead control data can be selected so as to be transferred with a transferrable data amount or less in the minimum block trigger interval in accordance with priorities.

For example, as shown in FIG. 6, when printhead control data are transferred upon being divided into data corresponding to three periods, data with a priority set value of 1 is always transferred in each period as long as a request for the printhead control data is asserted. In contrast to this, data with set values 2 and 3 each are transferred as long as the request for the printhead control data is asserted, and the remaining data amount of the data amount transferable in the minimum block trigger interval allows.

Second Embodiment

Although the first embodiment has given no consideration to a change in the speed of the carriage, the following will describe an example of performing data transferring in accordance with the speed of the carriage. More specifically, a transfer data count calculation unit 501 receives the interval of a block trigger signal BTRG generated by an encoder processing unit 112, and selects printhead control data transferable in the block trigger interval, in accordance with the operation of a carriage 2.

Figure 8:
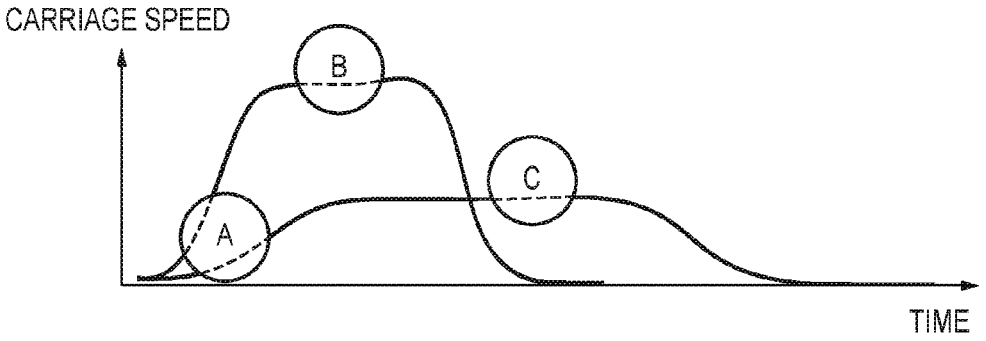
FIG. 8 is a graph showing a change in the speed of the carriage of the printing apparatus shown in FIG. 1.

FIG. 8 is a graph showing the relationship between the elapse time and the moving speed of the carriage, which reciprocally moves, in a forward pass (or backward pass). Referring to FIG. 8, A represents an acceleration section of the carriage; B, a (high-speed) constant speed section; and C, a (low-speed) constant speed section. Therefore, the carriage is operated at a higher speed in transition of A→B than in transition of A→C.

As described in the previous embodiment, the block trigger signal BTRG is generated based on a print resolution and a carriage speed. For this reason, as shown in FIG. 8, when the carriage speed is changed from A to B and from A to C, if the print resolution remains the same, the interval of the block trigger signal BTRG is minimum in period B, and the interval of the block trigger signal BTRG is maximum in period A.

Assume that in the following description, in this case, a data amount THB which is transferable within the interval of a block trigger signal calculated by the transfer data count calculation unit 501 is 25 bytes in period A, 15 bytes in period B, and 18 bytes in period C. Assume that in this embodiment, printing control data required for control on the printhead are printhead control data a to g described in the above embodiment, and the byte count of each data is the same as that described above.

Figure 9A:
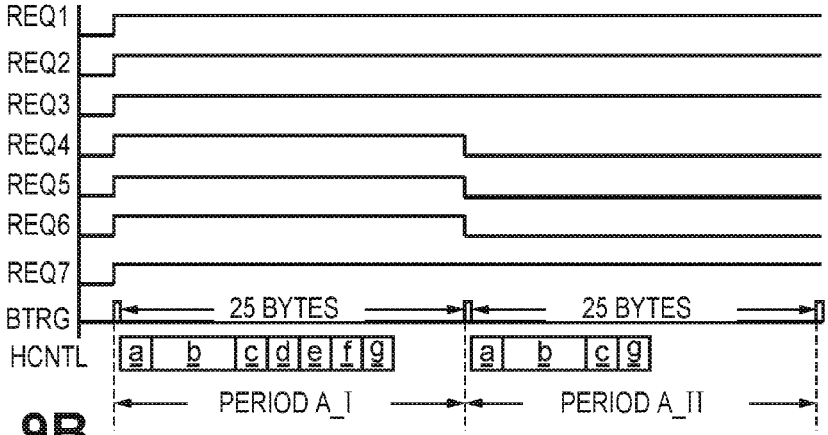
FIGS. 9A, 9B, and 9C are timing charts showing the divisional transfer timings of seven types of printhead control data based on a carriage speed.
Figure 9B:
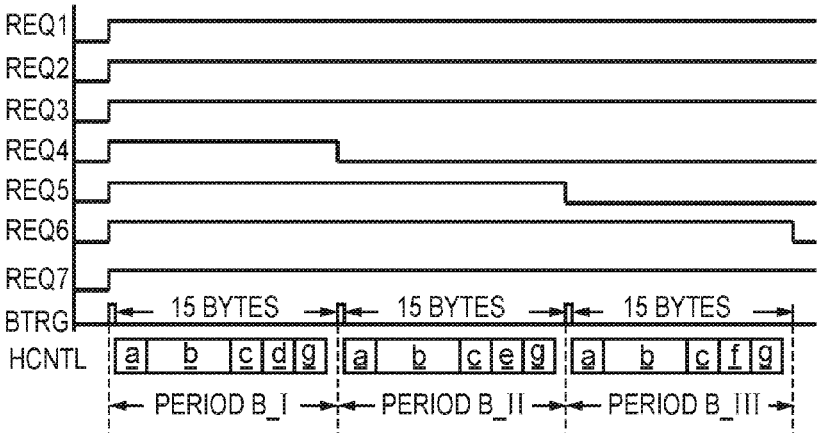
Figure 9C:
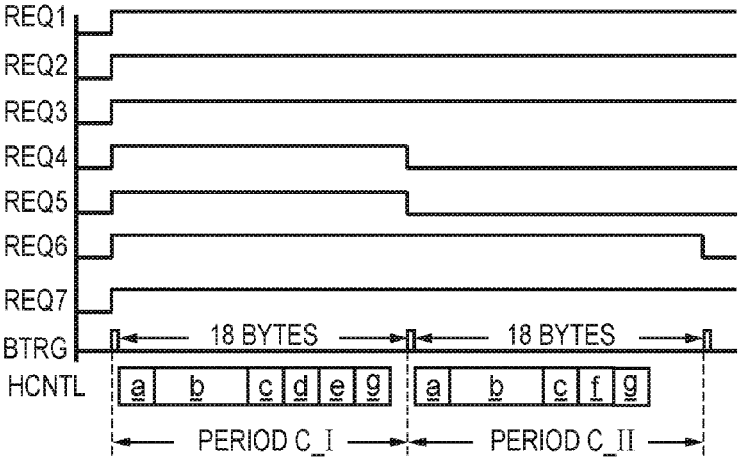

FIGS. 9A to 9C are timing charts each showing a transfer timing when the carriage speed varies and seven types of printhead control data are transferred to the printhead upon being divided into data corresponding to a plurality of periods.

FIG. 9A is a timing chart when transferring printhead control data with period A being divided into two periods. FIG. 9B is a timing chart when transferring printhead control data with period B being divided into three periods. FIG. 9C is a timing chart when transferring printhead control data with period C being divided into two periods.

Transfer processing in each of three periods will be described next.

(1) Transfer Processing in Period A

This processing will be described with reference to FIGS. 7 and 9A. Note that a repetitive description of processing described with reference to FIG. 7 will be omitted.

Period A_I

As described in the above embodiment, when the input of the block trigger signal BTRG from the encoder processing unit 112 is detected in step S601, transfer data selection processing is performed in step S602.

More specifically, after processing in steps S604 to S606, it is checked in step S607 whether the assertion of a request signal REQ1 for printhead control data a is detected. When the assertion of the request signal REQ1 is detected as in period A_I, a priority set value PRI of printhead control data a is checked in step S608. If PRI=1 as in period A_I, printhead control data a is selected as transfer data in step S610. In step S612, a byte count BYTE of printhead control data a is added to a transfer data byte count counter TDC.

Subsequently, in step S613, the value of a printhead control data count counter NDC is incremented by 1. In step S614, the printhead control data count counter NDC is compared with a printhead control data count ND. If NDC<ND, the process returns to step S606. If NDC≥ND, the processing is terminated.

If NDC=2, it is checked whether the assertion of a request signal REQ2 for printhead control data b is detected, and printhead control data b is processed in the same manner as printhead control data a described above. If NDC=3, it is checked whether the assertion of a request signal REQ3 for printhead control data c is detected, and printhead control data c is processed in the same manner as printhead control data a described above. If NDC=4, it is checked whether the assertion of a request signal REQ7 for printhead control data g is detected, and printhead control data g is processed in the same manner as printhead control data a described above.

Subsequently, if NDC=5, it is checked whether the assertion of a request signal REQ4 for printhead control data d is detected, and printhead control data d is processed. In this case, since the priority set value PRI of printhead control data d is set to "2", the process advances to step S606→S607→S608→S609. At this point of time, with processing up to NDC=4, TDC=13. In this case, since a byte count BYTE of printhead control data d is 2 and the data amount THB transferable within the interval of a block trigger signal is 25 bytes, it is determined in step S609 that TDC+BYTE THB, and the process advances to step S610.

In addition, processing for printhead control data e and f corresponding to NDC=6 and 7 is the same as that corresponding to printhead control data d. In this case, it is checked whether the assertion of a request signal REQ5 for printhead control data e and the assertion of a request signal REQ6 for printhead control data f are detected.

As shown in FIG. 9A, therefore, printhead control data HCTNL selected in period A_I includes printhead control data a, b, c, d, e, f, and g. The selected printhead control data are transferred to the printhead 3 in step S603.

Period A_II

As in period A_I, when the input of the block trigger signal BTRG from the encoder processing unit 112 is detected in step S601, transfer data selection processing is performed in step S602. More specifically, after the processing in steps S604 to S606, it is checked in step S607 whether the assertion of the request signal REQ1 for printhead control data a is detected.

As in period A_II, when the assertion of the request signal REQ1 is detected, it is checked in step S608 whether the priority set value PRI of printhead control data a is "1". As in period A_II, if PRI=1, printhead control data a is selected as transfer data in step S610. In step S612, the byte count BYTE of printhead control data a is added to the transfer data byte count counter TDC. Subsequently, in step S613, the value of NDC is incremented by 1. In step S614, NDC is compared with ND. If NDC<ND, the process returns to step S606. If NDC≥ND, the processing is terminated.

If NDC=2, it is checked whether the assertion of the request signal REQ2 for printhead control data b is detected, and printhead control data b is processed in the same manner as printhead control data a. If NDC=3, printhead control data c is processed in the same manner as printhead control data a in accordance with the detection of the request signal REQ3 for printhead control data c. If NDC=4, printhead control data g is processed in the same manner as printhead control data a in accordance with the detection of the corresponding request signal REQ7.

If NDC=5, printhead control data d is processed. However, as indicated by the request signal REQ4 in period A_II in FIG. 9A, if priority set value PRI=2, the request signal REQ4 for printhead control data d is negated in step S607. The process therefore advances to step S611, in which the printhead control data is not selected as transfer data. Subsequently, as described above, processing in steps S613 and S614 is executed.

Subsequently, since the request signals REQ5 and REQ6 for printhead control data e and f are negated, the printhead control data are processed in the same manner as printhead control data d.

As shown in FIG. 9A, therefore, the printhead control data HCNTL selected in period A_II includes printhead control data a, b, c, and g. The selected printhead control data are transferred to the printhead 3 in step S603.

In the above manner, in period A shown in FIG. 8, as shown in FIG. 9A, transfer data are selected and transferred to the printhead 3.

(2) Transfer Processing in Period B

This processing will be described with reference to FIGS. 7 and 9B. Note that a repetitive description of processing described with reference to FIG. 7 will be omitted.

Period B_I

As described in the above embodiment, when the input of the block trigger signal BTRG from the encoder processing unit 112 is detected in step S601, transfer data selection processing is performed in step S602.

More specifically, after processing in steps S604 to S606, it is checked in step S607 whether the assertion of a request signal REQ1 for printhead control data a is detected. When the assertion of the request signal REQ1 is detected as in period B_I, a priority set value PRI of printhead control data a is checked in step S608. If PRI=1 as in period B_I, printhead control data a is selected as transfer data in step S610. In step S612, a byte count BYTE of printhead control data a is added to a transfer data byte count counter TDC.

Subsequently, in step S613, the value of a printhead control data count counter NDC is incremented by 1. In step S614, the printhead control data count counter NDC is compared with a printhead control data count ND. If NDC<ND, the process returns to step S606. If NDC≥ND, the processing is terminated.

If NDC=2, 3, or 4, printhead control data b, c, or g is processed in the same manner as printhead control data a described above in accordance with the detection of the assertion of the corresponding request signal REQ2, REQ3, or REQ7.

Subsequently, if NDC=5, it is checked whether the assertion of a request signal REQ4 for printhead control data d is detected, and printhead control data d is processed. In this case, since the priority set value PRI of printhead control data d is set to "2", the process advances to step S606→S607→S608→S609. At this point of time, with processing up to NDC=4, TDC=13. In this case, since a byte count BYTE of printhead control data d is 2 and the data amount THB transferable within the interval of a block trigger signal is 15 bytes, it is determined in step S609 that TDC+BYTE THB, and the process advances to step S610.

If NDC=6 or 7, printhead control data e or f is processed. As indicated by FIG. 9B, in such a case, the assertion of the corresponding request signal REQ5 or REQ6 is detected. However, at this point of time, with processing up to NDC=5, TDC=15. In either case, it is determined in step S609 that TDC+BYTE>THB, and the process advances to step S611. As a consequence, printhead control data e or f is not selected as transfer data.

With the above processing, printhead control data a, b, c, d, and g are selected in period B_I. In step S603, the selected printhead control data HCNTL is transferred to the printhead 3.

Period B_II

Basically, the same processing as that in period B_I is executed in accordance with the flowchart shown in FIG. 7. In this case, however, since the request signal REQ4 is negated, printhead control data d is not selected as transfer data. In contrast to this, the assertion of the request signal REQ5 is detected. At this point of time, that is, with processing up to NDC=5, TDC=13. For this reason, printhead control data e is selected as transfer data.

In addition, although the assertion of the request signal REQ6 is detected. At this point of view, that is, with the processing up to NDC=6, TDC=15. Consequently, the printhead control data f is not selected as transfer data.

With the above processing, printhead control data a, b, c, e, and g are selected in period B_II. In step S603, the selected printhead control data HCNTL is transferred to the printhead 3.

Period B_III

Basically, the same processing as that in period B_I is executed in accordance with the flowchart shown in FIG. 7. In this case, however, the request signals REQ4 and REQ5 are negated, and hence printhead control data d and e are not selected as transfer data. In contrast to this, the assertion of the request signal REQ6 is detected. At this point of time, that is, with processing up to NDC=6, TDC=13. Consequently, printhead control data f is selected as transfer data.

With the above processing, printhead control data a, b, c, f, and g are selected in period B_III. In step S603, the selected printhead control data HCNTL is transferred to the printhead 3.

As described above, in period B shown in FIG. 8, transfer data are selected and transferred to the printhead 3, as shown in FIG. 9B.

(3) Transfer Processing in Period C

This processing will be described with reference to FIGS. 7 and 9C. Note that a repetitive description of processing described with reference to FIG. 7 will be omitted.

Period C_I

As described in the above embodiment, when the input of the block trigger signal BTRG from the encoder processing unit 112 is detected in step S601, transfer data selection processing is performed in step S602.

More specifically, after processing in steps S604 to S606, since the assertion of a request signal REQ1 for printhead control data a is detected in step S607, the priority set value PRI of printhead control data a is checked in step S608. In this case, since PRI=1, printhead control data a is selected as transfer data in step S610. In step S612, the byte count BYTE of printhead control data a is added to the transfer data byte count counter TDC.

Subsequently, in step S613, the value of a printhead control data count counter NDC is incremented by 1. In step S614, the printhead control data count counter NDC is compared with a printhead control data count ND. In this case, since NDC<ND, the process returns to step S606.

If NDC=2, 3, or 4, printhead control data b, c, or g is processed in the same manner as printhead control data a described above in accordance with the detection of the assertion of the corresponding request signal REQ2, REQ3, or REQ7.

Subsequently, if NDC=5, printhead control data d is processed. In this case, since the assertion of the request signal REQ4 for printhead control data d is detected and the priority set value PRI of printhead control data d is set to "2", the process advances to step S606→S607→S608→S609. At this point of time, with processing up to NDC=4, TDC=13. In this case, since the byte count BYTE of printhead control data d is 2 and the data amount THB transferable within the interval of a block trigger signal is 18 bytes, it is determined in step S609 that TDC+BYTE THB, and the process advances to step S610.

If NDC=6, printhead control data e is also processed in the same manner as printhead control data d.

Lastly, if NDC=7, the assertion of the request signal REQ7 is detected, as shown in FIG. 9C. However, at this point of time, that is, with processing up to NDC=6, TDC=17. For this reason, when the byte count BYTE of printhead control data f is added, it is determined in step S609 that TDC+BYTE>THB. As a consequence, printhead control data f is not selected as transfer data.

With the above processing, printhead control data a, b, c, d, e, and g are selected in period C_I. In step S603, the selected printhead control data HCNTL is transferred to the printhead 3.

Period C_II

Basically, the same processing as that in period C_I is executed in accordance with the flowchart shown in FIG. 7. In this case, however, the request signals REQ4 and REQ5 are negated, and hence printhead control data d and e are not selected as transfer data. In contrast to this, the assertion of the request signal REQ6 is detected. At this point of time, that is, with processing up to NDC=6, TDC=13. Consequently, printhead control data f is selected as transfer data.

With the above processing, printhead control data a, b, c, f, and g are selected in period C_II. In step S603, the selected printhead control data HCNTL is transferred to the printhead 3.

In the above manner, in period C shown in FIG. 8, transfer data are selected and transferred to the printhead 3, as shown in FIG. 9C.

According to the above embodiment, therefore, in a case where the moving speed of the carriage varies, it is possible to select printhead control data to be transferred by changing the data amount that is transferable within the interval of a block trigger signal in accordance with the speed and the print resolution.

In either of the embodiments, it is possible to select optimal transfer data based on a block trigger signal interval and the priority set value of each printhead control data even if the amount of printhead control data required to be transferred on the same signal line increases with a reduction in the number of signal lines connecting the printhead to the printing apparatus.

Although the two embodiments described above have exemplified the printing apparatus which reciprocally moves the carriage, the present invention is not limited to this. For example, the present invention can be applied to a printing apparatus configured to have a full-line printhead having a print width corresponding to the width of a print medium and mounted on a carriage and convey the print medium while the carriage is fixed. In this case, data transfer timings may be generated by generating block trigger signals using an encoder signal representing the position of a print medium in the conveying direction. Proper printhead control data can be selected and transferred in accordance with the conveying speed of a print medium which changes in this manner.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-107855, filed May 27, 2015, which is hereby incorporated by reference herein in its entirety.

What is claimed is:

1. A printing apparatus which causes a printhead to print on a print medium by transferring a plurality of data to the printhead and driving the printhead while moving the printhead and the print medium relatively to each other, the apparatus comprising:

a setting unit configured to set a value on a priority for each of the plurality of data to transfer the plurality of data;

a generation unit configured to generate print timings of the printhead in accordance with (1) a moving speed of the printhead or the print medium and (2) a print resolution of the printhead;

a selection unit configured to select, from the plurality of data, data to be transferred to the printhead in an interval between a print timing generated by the generation unit and a next print timing following the print timing, based on the interval, a data length of each of the plurality of data, and the values set by the setting unit; and a transfer unit configured to transfer data selected by the selection unit to the printhead.

2. The apparatus according to claim 1, wherein selection by the selection unit and transfer by the transfer unit are executed using a print timing generated by the generation unit as a trigger.

3. The apparatus according to claim 2, wherein the selection unit further selects data to be transferred to the printhead, based on a request signal requesting for data to be transferred to the printhead.

4. The apparatus according to claim 1, wherein the values are set for the plurality of data with respect to the selection unit in accordance with necessities of instantaneous execution from a transfer request, and the values on priorities are set to higher priorities as the necessities of the instantaneous execution increase, and are set to lower priorities as the necessities of the instantaneous execution decrease.

5. The apparatus according to claim 4, wherein the printhead includes a plurality of print elements, a sensor configured to measure a temperature of the printhead, and a sub-heater configured to control the temperature of the printhead.

6. The apparatus according to claim 5, wherein the plurality of data include print data for printing by the plurality of print elements, pulse data which drives the plurality of print elements, sub-heater data which drives the sub-heater, and selection data which selects the sensor.

7. The apparatus according to claim 6, wherein the priorities of the print data and the pulse data are higher than the priorities of the sub-heater data and the selection data.

8. The apparatus according to claim 1, further comprising:

a carriage configured to reciprocally move, with the printhead being amounted thereon; and an encoder configured to detect a position of the carriage in a moving direction, wherein the generation unit generates the print timing based on a signal detected by the encoder.

9. The apparatus according to claim 8, wherein a number of items of data falling within the interval selected by the selection unit changes in accordance with a moving speed of the carriage.

10. The apparatus according to claim 1, further comprising a conveyance unit configured to convey the print medium, wherein the generation unit generates the print timings based on a conveying speed of the print medium by the conveyance unit.

11. The apparatus according to claim 10, wherein the printhead comprises a full-line printhead having a print width corresponding to a width of a print medium conveyed by the conveyance unit.

12. A data transfer method for a printing apparatus which causes a printhead to print on a print medium by transferring a plurality of data to the printhead and driving the printhead while moving the printhead and the print medium relatively to each other, the method comprising:

setting a value on a priority for each of the plurality of data to transfer the plurality of data;

generating print timings of the printhead in accordance with (1) a moving speed of the printhead or the print medium and (2) a print resolution of the printhead;

selecting, from the plurality of data, data to be transferred to the printhead in an interval between a generated print timing and a next print timing following the print timing, based on the interval, a data length of each of the plurality of data, and the set values; and transferring the selected data to the printhead.

13. The method according to claim 12, wherein the selecting and the transferring are executed using the generated print timing as a trigger.

14. The method according to claim 13, wherein in the selecting, data to be transferred to the printhead is selected, based on a request signal requesting for data to be transferred to the printhead.

15. The method according to claim 12, wherein the values are set for the plurality of data with respect to the selecting in accordance with necessities of instantaneous execution from a transfer request, and the values on priorities are set to higher priorities as the necessities of the instantaneous execution increase, and are set to lower priorities as the necessities of the instantaneous execution decrease.

16. The method according to claim 15, wherein the printhead includes a plurality of print elements, a sensor configured to measure a temperature of the printhead, and a sub-heater configured to control the temperature of the printhead, and the plurality of data include print data for printing by the plurality of print elements, pulse data which drives the plurality of print elements, sub-heater data which drives the sub-heater, and selection data which selects the sensor.

17. The method according to claim 16, wherein the priorities of the print data and the pulse data are higher than the priorities of the sub-heater data and the selection data.

18. The method according to claim 12, wherein the printhead is mounted on a carriage and reciprocally moves, a position of the carriage in a moving direction is detected by an encoder, and the print timing is generated based on a signal detected by the encoder.

19. The method according to claim 18, wherein a number of items of data falling within the selected interval changes in accordance with a moving speed of the carriage.

20. The method according to claim 12, wherein the print timings are generated, based on a conveying speed of the print medium to be conveyed, and the printhead comprises a full-line printhead having a print width corresponding to a width of the print medium to be conveyed.

* * * * *